United States Patent [19]

Mele

[11] Patent Number: 4,608,848

[45] Date of Patent: Sep. 2, 1986

[54] PART FORMING APPARATUS BY FLOW FORGING

[76] Inventor: Joseph J. Mele, 188 Warner Ave., Huntington, N.Y. 11743

[21] Appl. No.: 647,900

[22] Filed: Sep. 6, 1984

[51] Int. Cl.[4] ..... B21J 13/04

[52] U.S. Cl. ..... 72/184; 72/207; 72/427

[58] Field of Search ..... 72/184, 192, 207, 452, 72/427; 74/569; 92/15, 161

[56] References Cited

U.S. PATENT DOCUMENTS

| | | | |
|---|---|---|---|
| 850,810 | 4/1907 | Worth et al. | 72/99 |
| 2,657,009 | 10/1953 | Neis et al. | 92/161 |
| 2,701,485 | 2/1955 | Felt et al. | 72/207 |
| 3,233,444 | 2/1966 | Groves et al. | 72/207 |
| 3,263,573 | 8/1966 | Fogelstrom et al. | 92/161 |
| 3,303,833 | 2/1967 | Melling | 74/569 |
| 3,490,261 | 1/1970 | Izett | 72/207 |
| 3,847,004 | 11/1974 | Bringewald | 72/184 |

FOREIGN PATENT DOCUMENTS

| | | | |
|---|---|---|---|
| 1266277 | 3/1972 | United Kingdom | 249/74 |

*Primary Examiner*—Lowell A. Larson
*Attorney, Agent, or Firm*—Erwin S. Teltscher

[57] ABSTRACT

An apparatus for forming a shaped part from a work includes two members spaced away from one another which define a pressure zone. First and second dies clamp the work therebetween, and a first roller conveyor transports at least one of the dies along a transport direction. A holder restrains the members from yielding along a direction transverse to the transport direction. At least one of the members defines an inclination with the transport direction, so as to cause the pressure zone to converge along the transport direction. A drive mechanism drives the dies to the pressure zone, and away therefrom; one of the dies includes a plurality of adjoining pressure-transferring elements. Each pressure-transferring element has a pressure-transfer surface on one end thereof facing the one of the members, and a molding surface on the other end thereof. Self-adjustable devices are interposed between the one of the members and the pressure-transfer surface of the pressure-transferring elements for smoothing and maximizing pressure transfer from the one of the members to the pressure transfer surface. The dies are shaped to exert a pressure on the members during the transport of the dies in a direction transverse to the transport direction, so that a smoothly increasing counter-pressure opposite to the pressure is applied to the work from the one of the members during the transport of the dies through the pressure zone along the transport direction through the matching devices and through the pressure-transferring elements so as to obtain the shaped part.

33 Claims, 45 Drawing Figures

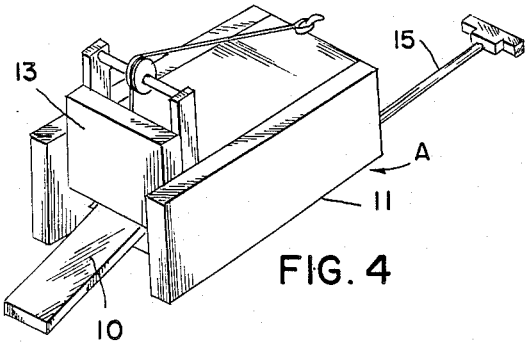
FIG. 4
FIG. 5
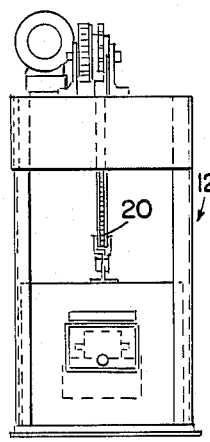
FIG. 6
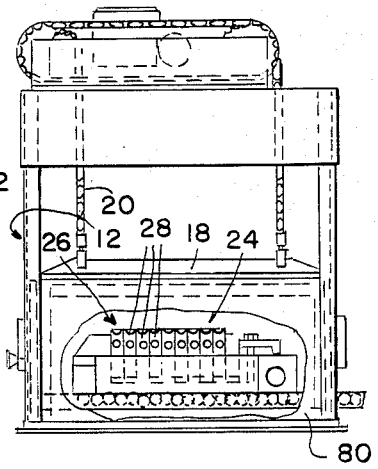
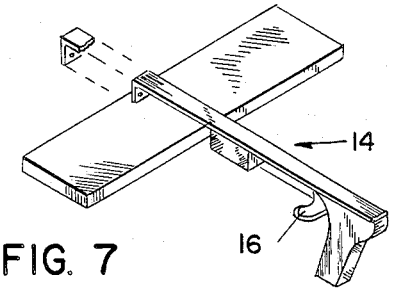
FIG. 7
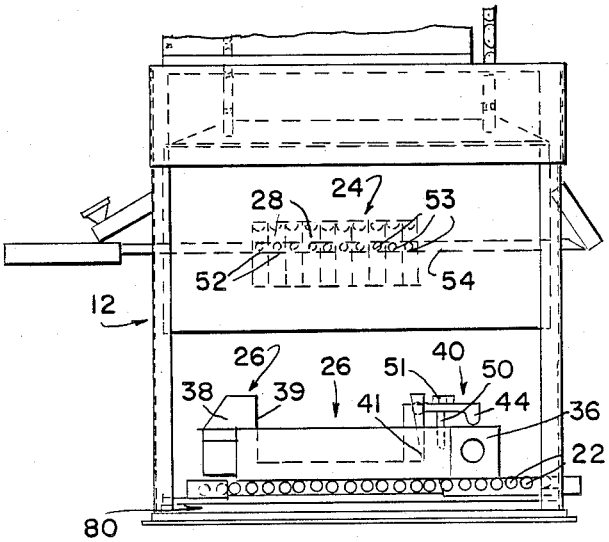
FIG. 8
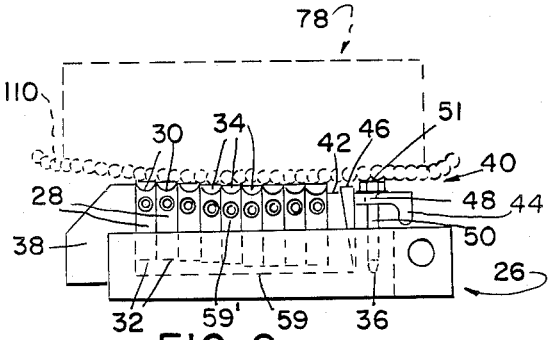
FIG. 9

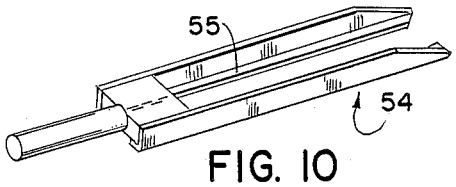
FIG. 10
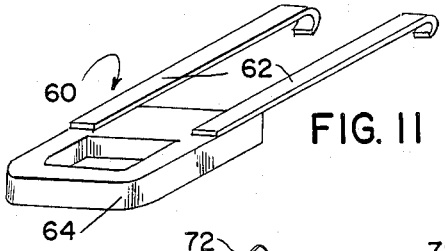
FIG. 11
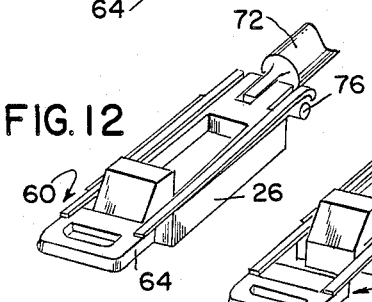
FIG. 12
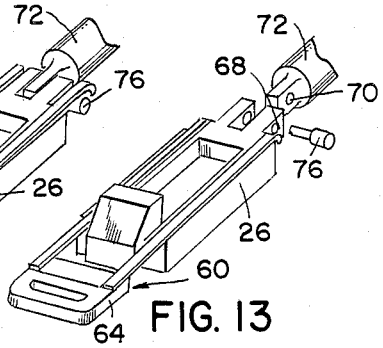
FIG. 13
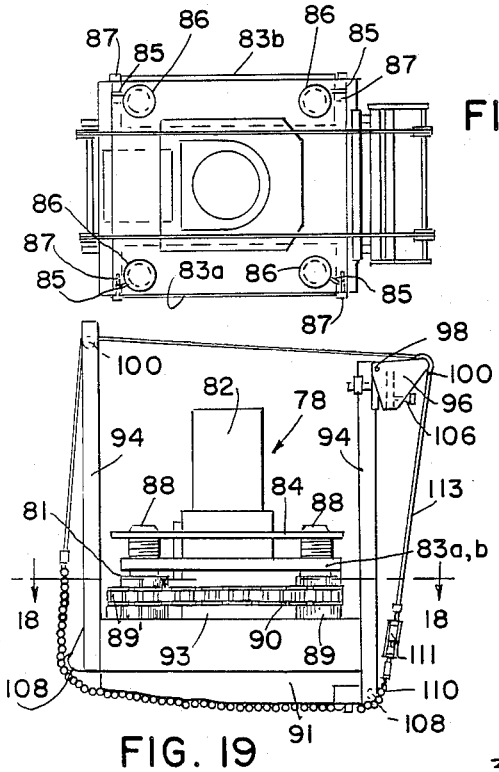
FIG. 17a
FIG. 19
FIG. 18
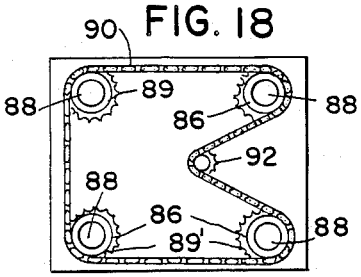
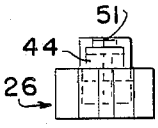
FIG. 17
FIG. 14
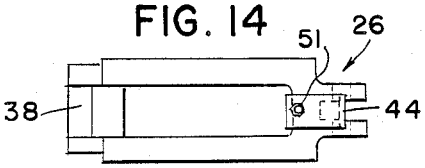
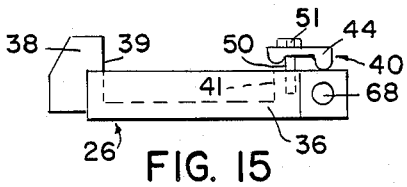
FIG. 15
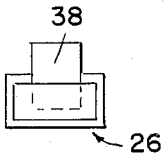
FIG. 16

FIG. 22
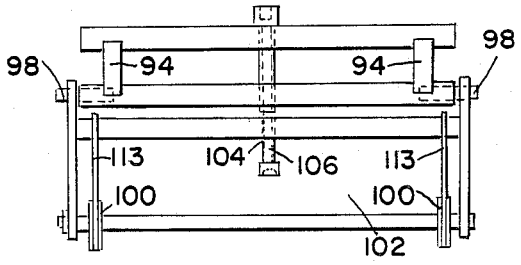
FIG. 23
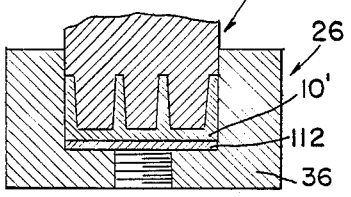
FIG. 20
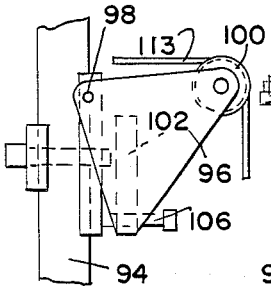
FIG. 21
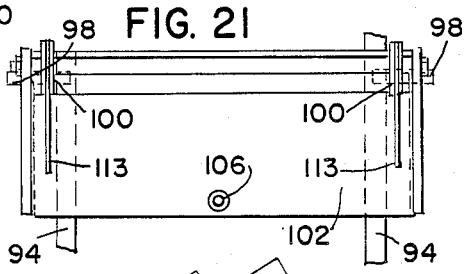
FIG. 24
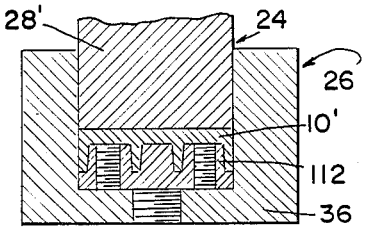
FIG. 25
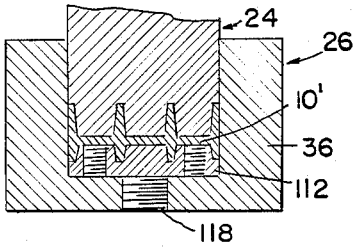
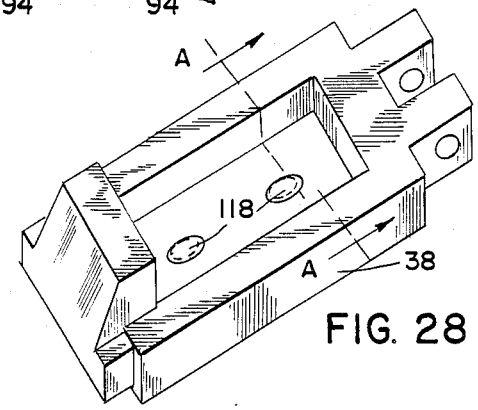
FIG. 28
FIG. 26
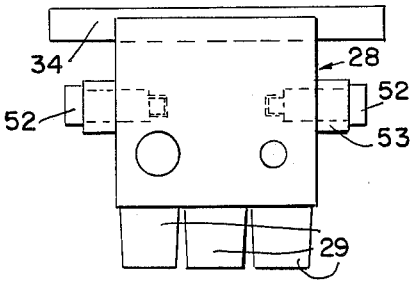
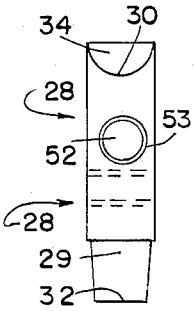
FIG. 27
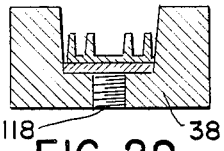
FIG. 29
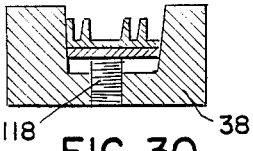
FIG. 30

FIG. 31
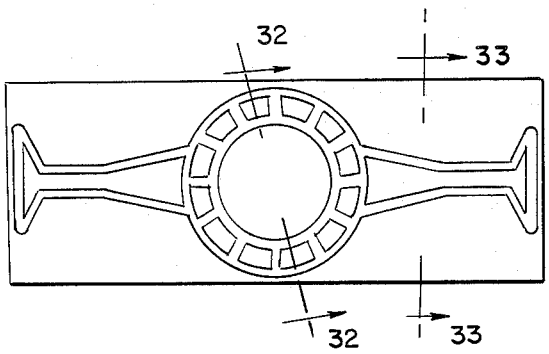
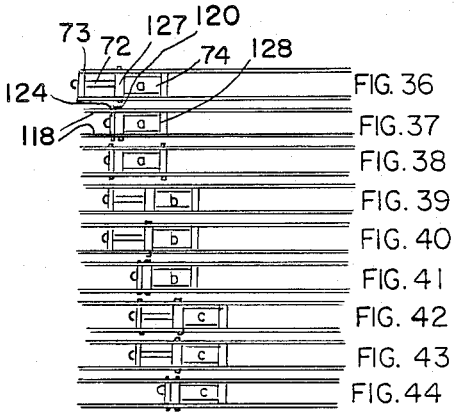
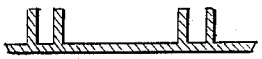
FIG. 32
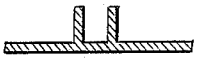
FIG. 33
FIG. 34
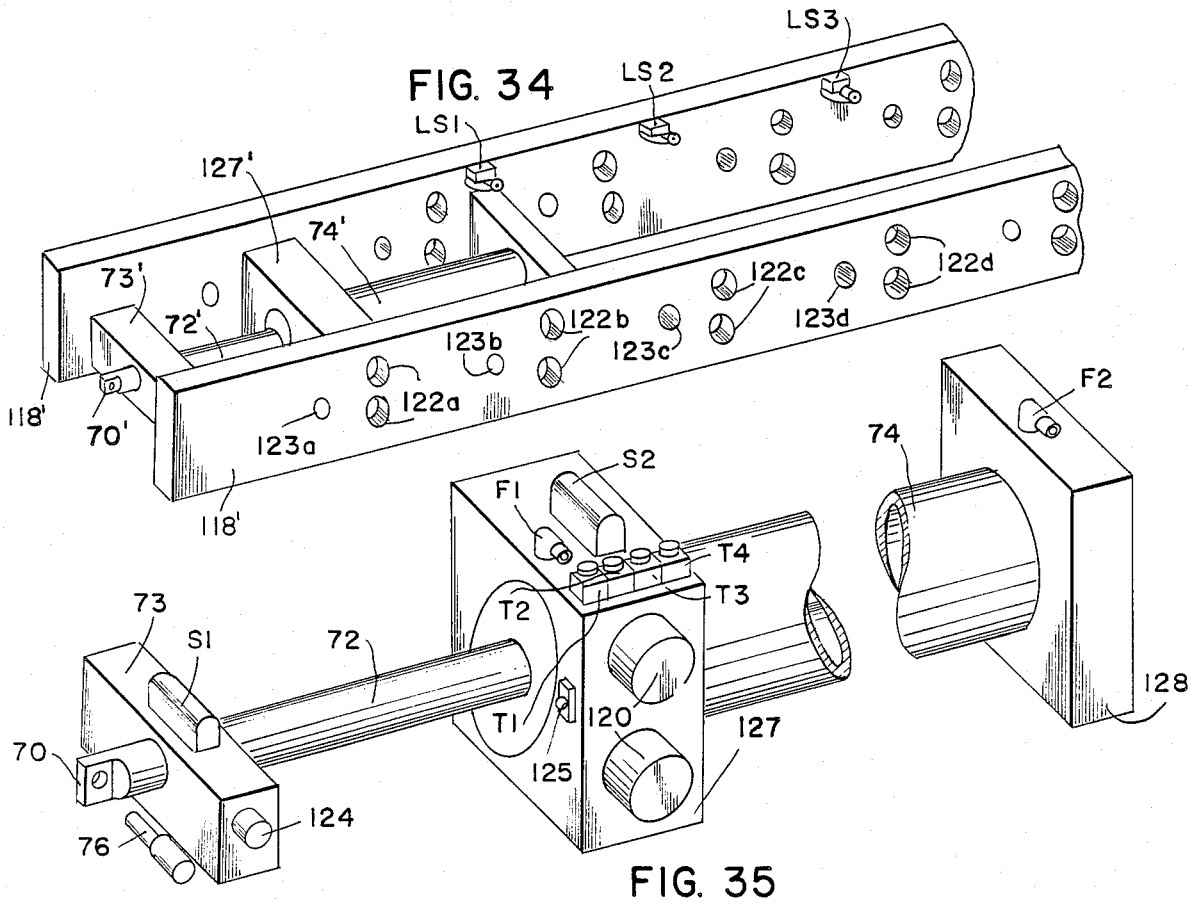
FIG. 35

PART FORMING APPARATUS BY FLOW FORGING

BACKGROUND OF THE INVENTION

From Bringewald, U.S. Pat. No. 3,847,004, there is known an apparatus for applying pressure, which includes a pressure base, pressure means vertically spaced above the pressure base to define a pressure zone, means for conveying work between the pressure base and the pressure means, and wherein one of the pressure base and the pressure means is inclined in the direction the work is conveyed. Rollers convert sliding friction into rolling friction as the work passes through the pressure zone, and means are provided for guiding the rollers as they pass under the pressure zone. An auxiliary pressure unit is adjustably mounted on the pressure means; additionally guide means are provided for the rollers as they pass under the pressure means, as well as adjusting means for adjusting the guide means to compensate for movement between the pressure means and the auxiliary pressure unit.

From Bringewald, U.S. Pat. No. 3,521,472, there has become known a process and an apparatus for the production of parts from ductile materials with integral stiffeners on one or both sides, and from Bringewald, U.S. Pat. No. 3,425,095 there has become known a process and an apparatus for producing metal plates with integral stiffeners.

The Bringewald U.S. Pat. No. 3,847,004, which postdates the Bringewald U.S. Pat. Nos. 3,521,472 and 3,425,098 references by approximately 4 and 6 years, respectively, is believed to be the closest reference to the present invention.

The Bringewald U.S. Pat. No. 3,847,004 patent has, however, several disadvantages. A principal disadvantage is the fact the rollers are linked together by the links, so as to form a chain, which in turn, has peaks and valleys on an outer surface thereof. As the work support is transported only by being disposed on a lower chain, slippage occurs between the work support and the lower chain, if the upper front edge of the frontmost force-translating element happens to lodge in one of the valleys, thus restraining any forward movement of the force-translating elements. This slippage cannot be eliminated if the work support is transported forwardly at a greater pull, or force. Furthermore, as pressure is initially exerted on the frontmost force-translating element downwardly, it will move downwardly, leaving a step between it and the next force-translating element. The resulting step can give rise to slippage again in a manner analogous to that caused by the front edge of the frontmost force-translating element. Such a slippage, in turn, causes firstly a non-uniform pressure being exerted on the work, and secondly a slow-down in the operation of the part-forming apparatus. Such a non-uniform pressure, in turn, causes the part to be formed with some deformities, at best resulting in non-uniform parts shaped by the apparatus according to Bringewald; thus a part made during one run does not necessarily resemble a part made during another run of the Bringewald apparatus.

SUMMARY OF THE INVENTION

It is accordingly an object of the present invention to obviate the disadvantages of the prior art, and in particular, to devise an apparatus which removes the cause of any slippage and deficiences in the parts formed.

This and other objects of the invention are attained by providing self-adjustable matching means interposed between the member defining an inclination with the transport direction and the other member, which defines, in turn, together with the inclination-defining member, a pressure zone. In this manner pressure transfer from top member to the work is smoothed and maximized, resulting, in turn, in a more uniform and speedier production of shaped parts. Slippage is further eliminated by implementing the drive of the dies in the form of a hydraulically operated cylinder-piston mechanism, which replaces the slippage-prone chain of the prior art.

By using a substantially rectangular platform formed with two pairs of threaded openings disposed substantially in mirror symmetry about the minor and major axes, respectively, of the rectangular platform, and four threaded studs disposed in the four openings, respectively, any bending forces acting on the threaded studs are eliminated, which constitutes an improvement of the two-column platform of the prior art.

By the pressure-transfer surface of each pressure-transferring element being concave, as viewed in the transport direction, and by the convex rod surface of each longitudinal rod of the matching means being in contact with the concave pressure-transfer surface of a corresponding pressure-transferring element, a large load-bearing surface is obtained, permitting, in turn, a longer life-span of the die. This contrasts favorably with the line contact of the prior art, which may be changed under large pressures to an indeterminate surface contact.

Other objects of the invention will in part become obvious, and will, in part become apparent form the claims following the specific description of the apparatus.

BRIEF DESCRIPTION OF THE DRAWING

The invention will be better understood with the aid of the drawing, in which

FIG. 4 is a perspective view of the preheating station, or material oven, in which the material to be formed is preheated;

FIG. 5 is a side view of the die oven, when closed;

FIG. 6 is an elevation view of the die oven, when closed;

FIG. 7 is a perspective view of one embodiment of the work holder;

FIG. 8 is an elevation view of the open die oven, with the upper, or male, and lower, or female die spaced from one another to permit insertion of work to be formed into a part;

FIG. 9 is a fragmentary elevation view of the upper die, showing a detail of the restraining means, and of the tightening means acting on the pressure-transferring elements;

FIG. 10 is a perspective view of the die separation means for separating the male die from the female die when the dies are in the die oven;

FIG. 11 is a perspective view of the die-moving tool;

FIG. 12 corresponds to FIG. 11, but showing the piston engaged with the die-moving tool;

FIG. 13 corresponds to FIG. 12, but showing the piston disengaged from the die-moving tool;

FIG. 14 is a plan view of the lower, or female die;

FIG. 15 is an elevation view of the lower, or female die;

FIG. 16 is a side view of the lower, or female die, as seen from the left of FIG. 15;

FIG. 17 is a side view of the lower, or female die, as seen from the right of FIG. 15;

FIG. 17*a* is a top plan view of the top member,

FIG. 18 is a section through the top member;

FIG. 19 is an elevation view of the top member;

FIG. 20 is a fragmentary detail of the tensioning mechanism in side view;

FIG. 21 is a fragmentary detail of the tensioning mechanism in elevation;

FIG. 22 is a fragmentary detail of the tensioning mechanism in plan view;

FIG. 23 is a section through the upper and lower dies with the work shaped into a part, and showing the material flow when using a segmented male plug, and an auxiliary, flat stripper plate on a side of the work opposite to that facing the male plug;

FIG. 24 is similar to FIG. 23, but shows a single male plug formed with a plurality of segments used on the bottom surface of the work, while the top part of the work faces a plurality of plugs, each having a flat operating surface;

FIG. 25 is also similar to FIG. 24, but uses a plurality of segmented male plugs on the top side of the work, but only a single segmented sculptured die plate on the bottom side of the work;

FIG. 26 is an elevation view of the male die;

FIG. 27 is a side view of the male die;

FIG. 28 is a perspective view of the lower or female die, showing details of the ejection screws;

FIG. 29 is a cross-section through the female die along line A—A of FIG. 28 before the ejection screws are operated;

FIG. 30 is a cross-section through the female die along line A—A of FIG. 28 after the ejection screws are operated;

FIG. 31 is a plan view of a typical airplane bulkhead formed by the apparatus, according to the present invention;

FIG. 32 is a cross-section of FIG. 31 along line A—A;

FIG. 33 is a cross-section of FIG. 31 along line B—B;

FIG. 34 is a perspective view of the piston-cylinder mechanism within guide rails;

FIG. 35 is a perspective view of the piston-cylinder mechanism with the guide rails removed for clarity's sake;

FIGS. 36 through 44 show progressive positions of the piston and cylinder when operated in the novel indexing sequence according to the present invention.

DESCRIPTION OF THE SPECIFIC EMBODIMENTS

Figure 1:
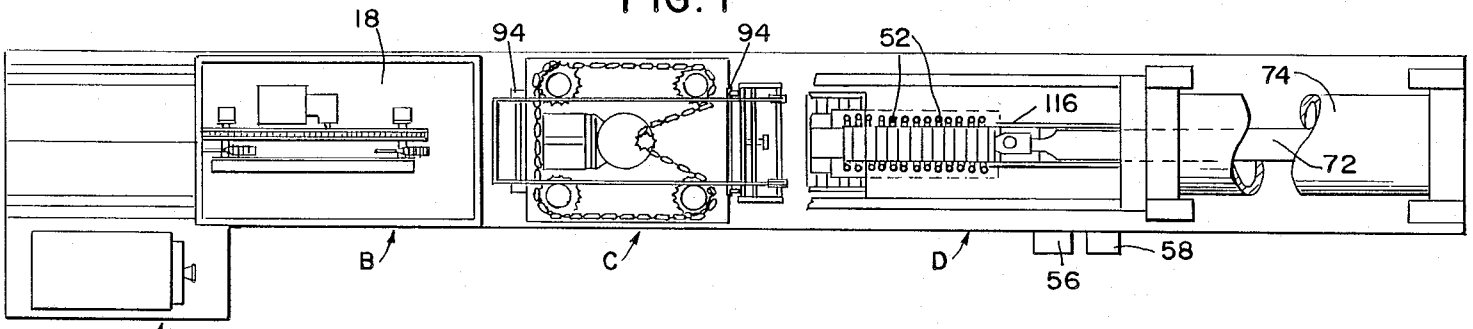
FIG. 1 is an overall plan view of the apparatus, according to the present invention.
Figure 2:
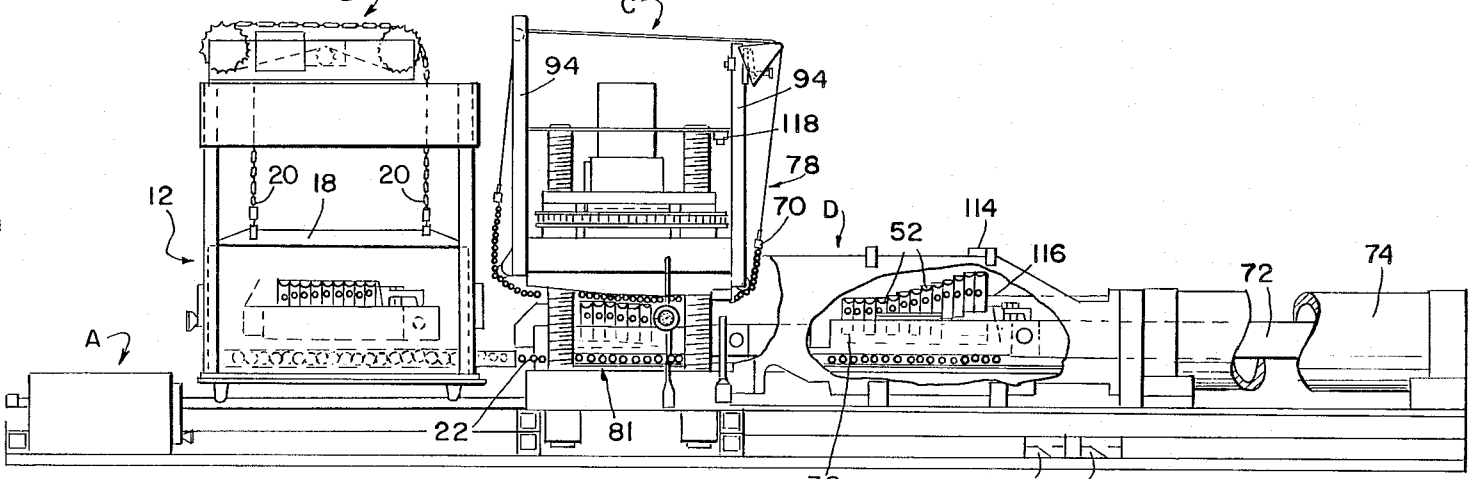
FIG. 2 is an overall elevation view of the apparatus shown in FIG. 1.
Figure 3:
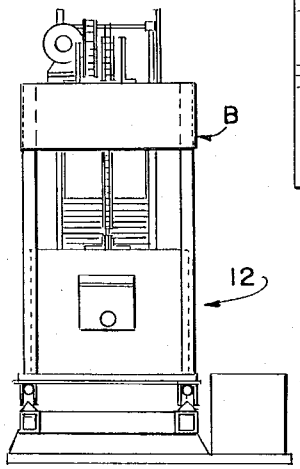
FIG. 3 is a side view of the apparatus shown in FIG. 1.

Referring now to the drawing, the overall arrangement of the part-forming apparatus by flow-forging is shown in FIGS. 1, 2 and 3, illustrating the overall plan view, overall elevation view, and side view of the inventive apparatus, respectively; an additional preheating station is shown in FIG. 4, and is denoted by A. A work-loading and heating station B, a part-forming station C, and a die-release station D will best be seen in FIGS. 1, 2 and 3.

A work 10, for example in the form of a blank, is normally first heated in the preheating station or material over A to a predetermined temperature, which is about 400°-900° F. in the case of aluminum, as can best be seen in FIG. 4. A door 13 of the material oven or preheating station A is lifted, and by means of a push rod 15 a lowermost work 10 (of several works piled upon one another) is pushed out from the material oven A. The work 10 is now ready to be transferred into the die oven 12 of the work-loading and heating station B, the die oven 12 being illustrated in a closed position thereof in FIGS. 5 and 6. It should be noted that it is also possible to dispense with the preheating station A, and to heat the work 10 only in the die oven 12. As the work is hot, work transfer means, for example in the form of a work holder 14, provided with remotely actuatable gripping means, for example in the form of a spring-loaded grip 16, are used to grip the work, shown in FIG. 7, which is thereafter placed into the open die oven 12 by the gripping means 16. In the open position of the die oven 12, an oven chamber 18 will be seen to be lifted by a conventional chain-and-sprocket mechanism 20, not further described in detail.

At this stage the die assembly, implemented, for example, as clamping means for holding the work 10, will already have been placed in the die oven 12. The die assembly, or die means, will be seen to consist of upper die means 24, and lower die means 26, as shown, for example, in FIG. 8. A more detailed view of the die assembly is shown in FIG. 9. The upper die means will be seen to consist of a plurality of plugs or pressure transferring elements 28. Each pressure-transferring element 28 is formed on a normally upper end thereof with a generally concave pressure transfer surface 30, and a lower molding surface 32, which actually comes into contact with the part to be formed from the work 10. Facing an inclined roller chain 110 of a top member 78, to be described later with the aid of FIGS. 18 and 19, there are disposed on each pressure-transferring element 28, alternately referred to as a male plug 28, self-adjusting matching means, for example, in the form of a longitudinal rod 34. Each longitudinal rod 34 has a substantially semi-spherical cross-section, so as to define a plane rod surface and a convex rod surface. Each rod 34 cooperates with a corresponding pressure-transferring element or male plug 28 so as to nestle therein facing a corresponding pressure-transfer surface 30, while facing the roller chain 110 of the top member 78 with the plane rod surface. In this manner, as will be seen later, each rod 34 is constrained to pivot about an axis substantially in the plane rod surface, so that the plane rod surface abuts the roller chain 110 of the top member 78 opposite the plane rod surface. The purpose of the self-adjustable matching means or rods 34 is to maximize pressure transfer from the top member 78 to the pressure surface 30, by each rod 34 automatically adjusting its position in response to the inclination of roller chain 110 of the top member 78 without jamming or jarring therewith, so that a gradually increasing pressure is applied to the work 10 from the top 78 member through the roller chain 110, the rods 34 and the pressure-transferring elements or male plugs 28, in order to obtain the shaped part. The mechanism by means of which the top member 78 applies pressure to the pressure surface 30 will be discussed later.

The lower die means, or female portion of the die 26, as best seen in FIGS. 8 and 9, consists substantially of a container 36, formed at the rear part or upstream portion thereof, as seen in the direction of transportation, with a wedge-shaped part 38, having an inner rear wall 39, and an inner front wall 41. One end plug of the plugs 28 normally abuts the rear wall 39, while the other end plug of the plugs 28 is normally spaced from the front wall 41. Plug holding or restraining means take the form, for example, of a wedge 42 cooperating with another wedge 46. The wedge 42 abuts the other end plug 28 with a first major surface thereof; the second major surface of the wedge 42 is transverse to the longitudinal direction of the container 36, and converges with the first major surface in a direction away from the bottom of the container 36. The wedge 46 abuts with one major surface thereof the other major surface of the wedge 42, while the other major surface of the wedge 42 converges with the one major surface portion of the wedge 46 in a direction transverse to the longitudinal direction of the container 36, and towards the bottom of the container 36. Tightening means 40 are mounted on the container 36 near the other end plug, and are constrained to move in the longitudinal direction of the container 38, so that upon actuation of the tightening means 40 in a predetermined sense, the plugs or pressure-transferring elements 28 are tightened to one another.

The tightening means 40 may consist, for example, of an L-shaped member 44, which has a normally horizontally projecting arm connected with a free end thereof to the other major surface of the wedge 46, and is formed with a threaded opening 48. A normally vertically positioned minor arm abuts with a free end portion thereof the rim of the container 38, and a bolt 50, which is threaded along a middle portion thereof, is normally engaged in the threaded opening 48. An upper end of the bolt 50 is formed with a head 51, and the other end of the bolt 50 is held in the container 38 so as to be freely rotateable therein. Consequently, when the bolt 50 is rotated in a predetermined sense, normally clockwise, the wedge 42 exerts a gradually increasing pressure on the other end male plug 28.

Each male plug 28 is formed with lateral projections 52, preferably in the form of cylindrically formed projections, which are provided so as to enable die separation means, to be described hereinafter, to separate the upper die means 24, for example in the form of an assembly of male plugs 28, from the lower, or female die means 26. In order to reduce friction, each projection 52 is surrounded by a rotatable collar 53, which is arranged to make contact with the die separation means.

In order to separate the upper die means 24 from the lower die means 26, the fork 54 is inserted through a lateral side of the die oven 12, so that the two prongs of the fork support the projections 52 on either side of the male plugs 28, respectively, and a switch 56 of the die oven 12, best seen in FIG. 2, is actuated, so that the upper die means 24, together with the fork 54 is raised, permitting the work 10 to be inserted by means of the work holder 14 between the upper die means 24 and the lower die means 26. Next a switch 58, also seen in FIG. 2, is energized to lower the die oven 18 to its initial position, so that the die oven 12 is closed, and thereafter the fork 54 is removed from the die oven 12 by withdrawing it laterally therefrom. The work 10, which is now resting between the upper die means 24 and the lower die means 26, is now soaked for approximately 10 minutes at a predetermined forming temperature, that temperature being indicated by thermocouples 59 and 59', which are located in the the lower die means 26, and the upper die means 24, respectively. Next the die oven 12 is opened again by energizing the switch 56, and the male plugs 28 are tightened by the aforementioned bolt 50 of the restraining means 40 being turned in a clockwise direction, so as to slide the wedge portions 42 and 46 against one another, tightening the male plugs 28 in the process to one another.

Next the complete die assembly is pushed forwardly by means of a die moving or pushing tool 60 illustrated in FIGS. 11, 12 and 13, the arms 62 of which are arranged to surround the longitudinal side of the die assembly, by pushing the handle 64 of the moving tool 60 forwardly. Each lower die means or female die 26 is formed with apertures 68, which are aligned with a hole 70 formed in the rear end of a piston rod 72, driven by nonillustrated drive means. The piston rod has preferably a diameter of 4 inches, and preferably has a tensile strength of about 100,000 psi. A connecting pin 76 is then forcibly pushed through the aperatures 68 and the hole 70, so as to insure a good fit, thus linking up the piston assembly and the die assembly. The die assembly is now ready to enter a pressure zone, where the work 10 will be shaped into a final formed part.

The pressure zone lies between a roller chain 110 of the top member or pressure unit 78, as seen in FIGS. 2 and 19, and a base member 80 best seen in FIG. 2, on which, as already shown in FIG. 8, there are disposed roller means, such as a roller conveyor 22. The base plate 80 is advantageously made of a heat-resisting material, such as transite. Thus the piston 72 drives, for example, pulls, the work 10 clamped between the upper die means 24 and the lower, or female die means 26 to the pressure zone. The lower, or female die means 26 is shown in top plan view, elevation view, front side view, and rear side view, respectively, in FIGS. 14–17.

In a preferred form of the invention, and as best seen in FIGS. 17*a*, 18 and 19, the top member or pressure unit 78 is provided with holder means or distance-adjusting means for selectably adjusting maintaining the distance between the top member 78 and a base member 81, as best seen in FIG. 2. A platform 84 above plates 83*a* and 83*b* is formed with four openings 86, through which pass four threaded screws 88, respectively, on which there are threaded nuts 89 welded to sprocket wheels 89', respectively, and linking means, for example a chain 90, operatively links the four sprocket wheels 89'. As seen in FIG. 17*a*, the non-threaded openings 86 formed in the platform 84 communicate with respective slots 85. Corresponding screws 87, bridging respective slots 85, can be tightened so as to permit the platform 84 to be merely clamped to the screws 88. A drive sprocket 92, driven by the motor 82, is also linked up with the chain 90 as shown, for example, in FIG. 18, so that the plates 83*a* and 83*b*, the motor 82 mounted on an upper platen 91, and the nuts 89 located between the platform 83 and the upper platen 91, can be made to move up and down, depending on the sense of rotation of the motor 82. A frame 94, seen for example, in FIGS. 19 and 20, is secured to the upper platen 91, which, in turn, is provided with tension adjusting means, such as a tensioning mechanism, shown in greater detail in FIGS. 20–22.

Two brackets 96 project outwardly from the frame 94 near one corner thereof. The brackets 96, of which only one is shown in FIGS. 19 and 20, are pivoted to the frame 94 about an axle 98 and carry on it pulleys 100. To each bracket 96 there is secured a connecting plate 102, which in turn, is formed with a threaded opening 104. A threaded bolt 106, which is freely rotatable in the connecting plate 102, passes through a threaded opening 104. Consequently the pulleys 100 can be moved further outwardly from the frame 94, or moved further inwardly by rotating the threaded bolt 106 counterclockwise, or clockwise, respectively. Freely rotatable rollers or pulleys 108 are mounted near the other three corners of the frame, 94. Roller means, such as a combination of an endless roller cable 113 and chain 110 passes around the pulleys 100 on top and the rollers 108 at the bottom, and its tension is adjustable by the aforesaid tensioning mechanism. The frontmost lower roller 108 is at a lower elevation, as seen in FIG. 19, than the rearmost lower roller 108, thus causing the roller means in the form of the roller chain 110, and consequently the pressure zone to converge along the transport direction of the work. The tension of the roller chain 110 and of the cable 113, in turn, is adjustably by a turnbuckle 111, best seen in FIG. 19, which links the roller chain 110 to a cable 113, the chain 110 and the cable 113 forming an endless loop.

The pressure zone will now be seen defined as extending between the roller conveyor 110, (which is located on an upper level, and is inclined to the transport direction,) and the roller conveyor 22, being located on the lower level. As the die assembly, including the upper die means 24, and the lower die means 26, is forcibly pulled forwardly by the piston 72, it comes in contact with the inclined plane, implemented by the roller chain 110. The die assembly, in particularly the upper die means 26, extends along a substantially horizontal plane before entering the pressure zone. However, upon entering the pressure zone, the die assembly is forced to align itself with the inclined plane. This results in the familiar action and reaction phenomenon, namely the top member 78 causes each male plug 28 to be gradually and successively pressed onto the work 10. This in turn causes the material to flow, so as to eventually assume the desired configuration. This is illustrated in FIG. 23, where the work 10 will be seen to be shaped into a part 10, having been molded between upper male plugs 28' and a stripping plate 112 placed on an inner bottom of the container 36 of the lower die means, and wherein each male plug 28' has a flat operating surface; in FIGS. 24 and 25, however, there are illustrated alternate ways of shaping the part 10, by making use of an segmented male plugs 28. In the examples illustrated, each male plug 28 is provided, for example, with three prongs 29, which serve, for example, to form cavities in the work 10, which is to be formed into a part, into separate open-ended chambers. In FIG. 24 the segmented male plugs 28 are disposed below the work 10, while male plugs 28', which have each a flat operating surface, are placed above the work 10. In FIG. 25 segmented male plugs 28 are used on each side of the work 10. Each projection 52 extending from a male plug 28' is surrounded by a roller 53, freely rotatable thereon. This feature reduces friction when the upper male plugs are separated from the female or lower die by the die separation means discussed earlier.

During the movement of the die assembly within the pressure zone, the rollers of the roller conveyors 22 and 110 rotate and thus greatly reduce any friction that would otherwise be created by a fixed inclined plane and the high pulling force developed by the driving force of the piston assembly, in the absence of any rollers.

Following completion of the molding process, the die means holding the now shaped part 10' are made to enter a die release station D, seen, for example, on the right-hand side of FIGS. 1 and 2. The die release station D is provided with die separating means in the form of longitudal wedges 116 interposed, on one hand, between the projections 52, extending on each side of a male plug 28, and on the other hand, the upper rim of the container 36 of the lower die means 26. The transport action of the piston 72 thus results in the male plugs 26 being lifted out of the lower die means, or female die 26, thus providing free access to the shaped part 10'. As the group of male plugs 28 emerge from the lower die means, or female die 26, the frontmost or lead male plug 26 comes in contact with a limit switch 114, best seen in FIG. 1, which in turn actuates the drive motor 82 of the top member 78, so as to drive the member 78, which has mounted thereon the roller or chain 110, upwardly, thus moving the top member 78 away from the base member 80. The upward travel of the top member 78 is eventually stopped by another limit switch 118, shown in FIG. 1. The piston rod 72 is now moved in a rearward direction past the top member 78, to the end of its travel.

While the part is being formed, and also during the time period the formed part 10' is returned to the home position, the die oven 12 is made to travel away from the loading position and the parallel support or base member 80 is raised to support the lower conveyor roller 22 on which the female die 26 is traveling. Thus at the end of the leftward cylinder return stroke, the roller conveyor 22, which carries the female die 26, which, in turn, contains the shaped part 10', comes to rest on the parallel support plate, or base member 80. Thereafter the connecting pin 76 is withdrawn from the piston rod 74. The female die 26 is inverted, namely rolled about its longitudinal axis by 180°, and two set screws 118, as seen in FIGS. 23, 24, 25, 28, 29 and 30, threaded into the base of the container 38 of the female die 26, and normally flush with the upper surface of the recess formed in the container 38, are rotated clockwise, so as to eject the formed part 10' therefrom.

After the formed part 10' has been ejected from the female die 26, the female die 26 is returned to its normal upright position, and re-engaged with the piston rod 72 through the connecting pin 76. The piston rod 72 is now advanced so as to be directly under the wedges 116 shown in FIGS. 1 and 2, and the threaded bolt 50 is rotated counter-clockwise (FIG. 9) so as to permit reinsertion of the male plugs 26 for another cycle. In preparation for this subsequent cycle the piston rod 72 is also moved to the loading position, the die oven 12 is raised again, and is ready to receive the returning die assembly, into which another work material has been inserted. The connecting pin 76 is withdrawn from the piston rod 72, and the die assembly is retracted into the die oven 12 at the set longitudinal spacing, so that it can subsequently be lowered without encountering any interference with any other elements. Before the die oven 12 is lowered, however, the die thermocouples 59 and 59' are reinserted into the male and female dies 24 and 26, respectively. Thereafter the die oven 18 is returned to the initially occupied lower position. The apparatus is now ready to commence another cycle.

A large shaped part 10', typical of a bulkhead of an airplane, is shown in FIG. 31, and in cross-section along line A—A of FIG. 31 in FIG. 32, while being shown in cross-section along line B—B of FIG. 31 in FIG. 33. Such a part, if 8' or greater in diameter, cannot be fabricated by conventional forging methods.

The present invention therefore also proposes a specific piston drive mechanism which permits arbitrary long strokes, while using only a limited piston length and a correspondingly limited cylinder length. The drive mechanism can be moved to predetermined positions within arbitrarily long indexing plates.

Construction of an extendable piston-cylinder mechanism permitting a considerable increase of a piston stroke is shown in FIGS. 36*a* through 36*j*. A perspective view of the indexing side plates 118 of the extendable piston-cylinder mechanism is shown in FIG. 34, and a perspective view of the piston assembly is shown in FIG. 35. The extendable piston-cylinder mechanism operates as follows:

Longitudinal guidance means, for example, in the form of parallel index plates 118 receive therein a cylinder 74 and a piston 72. A piston member 73 is secured to the piston 72 at an end thereof facing away from the cylinder 74. The cylinder 74 is provided with first locking means, for example, with a retractable pair of locking pins 120, which fit into respective openings 122 formed in the index plates 118. The piston member 73 is provided with second locking means, for example retractable engagement pins 124, which operate in a manner similar to those of locking pins 120, and fit into corresponding locking holes 123. The locking pins 120 and the engagement pins 124 releasably lock the cylinder 74 and piston member 73, respectively, to the index plates 118, and are actuated by actuating means to be described later, for example limit switches in conjunction with a timer. Selection means are provided for initially selecting a first location, for example the location a in FIGS. 36*a*–36*c*, from a plurality of n locations, so that the cylinder can be releasably locked by means of the locking pins 120 being inserted into corresponding openings 122, and by the engagement pins 124 being inserted into corresponding holes 123. The selection means are subsequently programmed to select a second location b downstream of the first location a, following movement of the piston 72 in forward direction into the cylinder 74. The cylinder 74 is then locked to the index plates 118' by the locking pins 120 engaging corresponding openings 122, and by the engagement pins 124 engaging corresponding holes 123. Subsequently the cylinder 74 and the piston member 73 are released from the index plates 118, and moved to, or near the location b, and the locking pins 120 and the engagement pins 124 are actuated to lock the cylinder 74 and the piston member 73 to the index plates 118 at the location b.

This process is then continued up to an $n^{th}$ location in a timely sequence. These movements are reversible thereafter in a corresponding reverse direction.

A specific example of this method of obtaining an arbitrarily long stroke with a piston and a cylinder of limited length, limited only by the length of the index or guidance plates is as follows:

At the start of a cycle to form a part the process, the pair of pins 120 engage the pair of openings 122*a*, respectively. As the piston rod 72 moves, or is retracted into the cylinder 74, by hydraulic pressure being applied to a hydraulic entry port $F_1$, the piston end member 73 secured to the piston rod 72 approaches a hole 123*a* on each side of the index or guidance plates 118. Towards the end of this approach movement, the piston member 73 makes contact with a limit switch 125 located on the end portion 127 of the cylinder 74, which also carries the retractable locking pins 120. The activation of the limit switch 125, in turn, (a) shuts off the hydraulic pressure normally acting on the piston 72, by closing off entry port $F_1$, (b) energizes a solenoid $S_1$ to cause the engagement pins 124 to engage the holes 123*a* formed on the index plates 118, respectively, and (c) energizes a first timer $T_1$. At the end of the time cycle of the timer $T_1$, a solenoid $S_2$ is energized, which, in turn, causes the pins 120 to be retracted from the openings 122*a*, and also starts the action of a second timer $T_2$. At the end of the cycle time of the timer $T_2$, an entry port $F_2$ located on an end member 127 of the cylinder 74' opens, and hydraulic pressure is applied to the entry port $F_2$. This causes the cylinder 74 to travel to the right, as seen, for example, in FIG. 35, until a limit switch $LS_1$ mounted on the index plates 118 is activated. Activation of the limit switch $LS_1$ shuts off hydraulic pressure at the entry port $F_2$, and also activates the solenoid $S_2$ to extend the pins 120 so that they may enter the openings 122*b*, as well as activating a timer $T_3$. At the end of the cycling time of the timer $T_3$, the latter causes the solenoid $S_1$ to be activated so that the pins 124 are retracted from the holes 123*a*, and also activates a timer $T_4$. At the end of the timing cycle of the timer $T_4$, the entry port $F_1$ is activated, so that hydraulic pressure is applied to $F_1$, which, in turn, causes the piston 72' to travel rightwardly, as seen in FIG. 35, until it makes contact with the limit switch 125. This process is repeated a desired number of times, until the end of travel along the index plates 128 is reached.

The cycle of the respective timers will usually be set within a range of 2–5 secs; it will be understood that the timers can also be replaced by a programmed computer.

The aforedescribed cycle is a continuous cycle, until the last limit switch turns off the entire system at the end of the (lengthened) stroke.

The piston-cylinder mechanism can be returned to the initial or starting position by reversing the aforecited steps, or by using a (non-illustrated) chain or cable to return the piston-cylinder mechanism to the initial position, of course with the locking pins 120, and the engagement pins 124 being in their rectracted positions.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passes through said converging pressure zone, wherein each self-adjustable matching means includes a longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges.

2. The apparatus as claimed in claim 1, wherein said one of said members is a top member disposed vertically above the other of said members, the other of said members being a base member.

3. The apparatus as claimed in claim 1, wherein said drive means includes a hydraulically operated cylinder-piston mechanism, and wherein the piston thereof has a predetermined stroke length, and is reciprocally movable into, and out of the cylinder, respectively.

4. The apparatus as claimed in claim 3, further comprising coupling means for coupling said die means to said cylinder-piston mechanism.

5. The apparatus as claimed in claim 3, further comprising holding means mounted on the other die means for holding said pressure-transferring elements together under pressure.

6. The apparatus as claimed in claim 5, wherein the other die means include a longitudinal container having a bottom, a rear wall, and a front wall, and wherein said pressure-transferring elements are received in said container, one end pressure-transferring element of said pressure-transferring elements normally abutting one of said walls, the other end pressure-transferring element being normally spaced from the other of said walls, restraining means abutting the other end pressure-transferring element, and tightening means mounted on said container near said other end pressure-transferring element, and being constrained to move in the longitudinal direction of said container so that upon movement of said tightening means in a predetermined sense said pressure-transferring elements are tightened to one another.

7. The apparatus as claimed in claim 6, wherein said tightening means are rotatable, and wherein said movement of said tightening means is a rotation thereof.

8. The apparatus as claimed in claim 7, wherein said longitudinal container has a rim, and whererein said restraining means comprise a first wedge abutting said other pressure-transferring element with a major surface thereof, the other major surface of said first wedge converging with said one major surface of said first wedge in a direction away from the bottom of said container, and transverse to said longitudinal direction, and a second wedge abutting with one major surface portion thereof the other major surface of said first wedge, said other major surface of said first wedge converging with said one major surface portion of said second wedge in a direction towards the bottom of said container, and transverse to said longitudinal direction, and wherein said tightening means comprise an L-shaped member having a normally horizontally positioned major arm connected with a free end thereof to said other major surface portion of said second wedge, and being formed with a threaded opening, and a normally vertically positioned minor arm abutting with a free end portion thereof said rim of said container, and a bolt threaded along a middle portion thereof, being engaged in said threaded opening, and having one end formed with a head, the other end thereof being held in said container so as to be freely rotatable therein, whereby, upon rotation of said bolt in said predetermined sense said first wedge exerts a gradually increasing pressure on said other pressure-transferring element.

9. The apparatus as claimed in claim 3, wherein said piston includes a piston rod of approximately four inches diameter, and having a tensile strength of about 100,000 p.s.i.

10. The apparatus as claimed in claim 3, wherein said cylinder-piston mechanism includes moving means for alternately moving said piston and said cylinder, respectively, along a first direction, and in a second direction opposite to said first direction in respective discrete steps so as to define an effective stroke length, each discrete step corresponding approximtely to said predetermined stroke length, whereby the effective stroke length of said cylinder-piston mechanism is increased to substantially an arbitrary multiple of said predetermined stroke length.

11. The apparatus as claimed in claim 10, wherein one of said members is stationary, and further comprising a piston member secured to said piston at an end thereof facing away from said cylinder, and wherein said piston and said cylinder may assume a retracted configuration, when said piston is disposed within said cylinder, and may assume an extended configuration, when said piston is disposed at least partly outside said cylinder, and wherein said moving means include longitudinal guidance means rigid with said stationary member for slidably receiving said cylinder and said piston therein, cylinder locking means connected to said cylinder for releasably locking said cylinder to said guidance means, piston member locking means connected to said piston member for releasably locking said piston member to said guidance means, and selection and actuation means for moving said piston and said cylinder in forward and reverse directions in a progression of incremental movements, wherein each forward incremental movement includes the operations of alternately (a) commanding said cylinder and said piston to assume said extended configuration in a first position thereof, while commanding said cylinder locking means to lock said cylinder to said guidance means, and thereafter commanding said piston to move in a forward direction so that said cylinder and said piston assume said retracted configuration, (b) commanding said piston locking member means to lock said piston member to said guidance means, thereafter commanding said cylinder locking means to unlock said cylinder from said guidance means, and thereafter commanding said cylinder to move in said forward direction until said cylinder and said piston assume said extended configuration, whereby said cylinder and said piston occupy a second position further advanced along said forward direction than said first position, and (c) substantially repeating operations (a) and (b) until said piston and said cylinder assume a final desired position in said extended configuration, and wherein each reverse incremental movement includes the operations of alternately (d) commanding said cylinder to move in a reverse direction opposite to said forward direction until said cylinder and said piston assume said retracted configuration, thereafter commanding said cylinder locking means to lock said cylinder to said guidance means, and then commanding said piston member locking means to unlock said piston member from said guidance means, (e) commanding said piston to move in said reverse direction until said piston and said cylinder assume said extended configuration, whereby said cylinder and said piston assume another position further removed from said final position along said reverse direction, and (f) substantially repeating operations (d) and (e) until said piston and said cylinder assume said first position in said extended configuration.

12. The apparatus as claimed in claim 11, wherein said guidance means is formed with a plurality of openings, and a plurality of holes, and wherein said cylinder locking means includes a plurality of locking pins releasably engaging corresponding openings, and said piston member locking means includes a plurality of engagement pins releasably engaging corresponding holes.

13. The apparatus as claimed in claim 12, wherein said selection and actuation means include a plurality of solenoids, operable to actuate corresponding of said locking pins and of said engagement pins, hydraulic means to move said piston and said cylinder, and a timer timed to operate said solenoids and said hydraulic means at preselected time intervals.

14. The apparatus as claimed in claim 10, further comprising a piston member secured to said piston at an end thereof facing away from said cylinder, and wherein said moving means include longitudinal guidance means for receiving said cylinder and said piston therein, cylinder locking means for releasably locking said cylinder to said guidance means, piston member locking means for releasably locking said piston member to said guidance means following movement of said piston from a position outside of said cylinder into said cylinder along said first direction, and selection means for (a) initially selecting a first location from a plurality of locations on said guidance means, so that said cylinder can be releasably locked to said first location, and for (b) thereafter selecting a second location downstream of said first location in a timely sequence along said first direction, following movement of said piston into said cylinder, locking of said piston member to said guidance means by said second locking means, release of said cylinder from said guidance means, and movement of said cylinder to said second location, so that said cylinder locking means can lock said cylinder to said second location, and thereafter, (c) continuing (b) up to an $n^{th}$ location in said timely sequence, said movements being thereafter reversible in a corresponding reverse sequence along said second direction.

15. The apparatus as claimed in claim 1, further comprising a work loading and heating station upstream of said pressure zone for receiving and heating the work up to a predetermined temperature, said work loading station being arranged to receive said die means, and a die release station downstream of said pressure zone for separating said die means from one another.

16. The apparatus as claimed in claim 15, wherein said die release station includes die-separating means for separating one of said die means from the other of said die means following shaping of said work into said part.

17. The apparatus as claimed in claim 16, wherein said die release station further includes a pair of rails located above a plane operatively defining an upper surface of said other die means, and wherein said die separating means includes a pair of longitudinal wedges secured to said rails, the thin end of each wedge facing said work loading station.

18. The apparatus as claimed in claim 15, wherein said work loading and heating station includes a die oven openable to receive said die means, and closeable thereafter.

19. The apparatus as claimed in claim 18, further including a preheating station downstream of said loading and heating station for receiving and heating the work, and transfer means for transferring the heated work from said preheating station to said die oven.

20. The apparatus as claimed in claim 18, wherein said transfer means includes a work holder provided with remotely actuatable gripping means for gripping the work, following heating thereof in said preheating station, and for releasing the gripped work from said gripping means.

21. The apparatus as claimed in claim 20, further comprising preloading die separation means connectable to one of said die means for separating said die means from one another, whereby the work heated in said preheating station can be placed between said dies by said gripping means.

22. The apparatus as claimed in claim 1, wherein said holder means included distance-adjusting means for selectably adjusting the distance between said two members to a desired spacing.

23. The apparatus as claimed in claim 22, further comprising second roller means wrapped at least partly around one of said members and operatively exerting a pressure on said one of said die means, and having an adjustable inclination with respect to said transport direction, and wherein said distance-adjusting means includes a platen, plate means disposed above said platen, a plurality of threaded studs disposed on said platen, a plurality of nuts threaded onto said studs, respectively, and held between said platen and said plate means, linking means in operative engagement with said nuts, and driver means operatively connected to said linking means, and rotatable by a selected number of rotations, said selected number of rotations corresponding to said desired spacing, whereby, upon rotating said driver means by said selected number of rotations, the distance between said two members is adjusted to said desired spacing.

24. The apparatus as claimed in claim 23, wherein said plate means includes two separate plates.

25. The apparatus as claimed in claim 24, wherein said linking means includes a chain, and further including a sprocket mounted on each nut, said chain engaging said sprocket wheels.

26. The apparatus as claimed in claim 23, wherein said second roller means includes a roller chain, and a cable secured to said roller chain, and forming an endless member therewith, said endless member having a selectable tension, and further comprising tension adjusting means for adjusting said tension.

27. The apparatus as claimed in claim 26, wherein said distance-adjusting means includes a substantially upright frame, and wherein said tension-adjusting means includes two rollers and two pulleys mounted on said frame near respective corners thereof, said cable being guided in said pulleys.

28. The apparatus as claimed in claim 27, further comprising a bracket pivotably mounted on said frame near one corner thereof so as to subtend a selected angle with said frame, and adjustable fixing means for maintaining said predetermined angle, one of said pulleys being mounted on said bracket so that the inclination of said roller chain is adjustable within predetermined limits in dependence of said selected angle.

29. The apparatus as claimed in claim 1, wherein the other of said die means normally receives said work, and includes removal means for removing the work therefrom following removal of said one of said die means from said holder means.

30. The apparatus as claimed in claim 29, wherein the other of said die means includes a container defining an inner surface, and at least one screw rotatably held in said container, said screw being normally flush with said inner surface, but adjustable for ejecting the work from said container along a predetermined direction, upon being rotated by a preselected angle so as to advance along said predetermined direction.

31. The apparatus as claimed in claim 1, wherein each pressure-transfer surface of each pressure-transferring element is concave, and wherein said longitudinal member of each self-adjustable matching means includes a longitudinal rod having a substantially semi-spherical cross-section so as to define said plane surface and a convex rod surface along said longitudinal direction, each rod cooperating with a corresponding of each pressure-transfer elements so as to nestle therein facing the pressure-transfer surface thereof with said convex rod surface, and wherein said longitudinal axis is substantially in said plane surface.

32. An apparatus for flow-forging a shaped part from a work, comprising in combination two members spaced away from one another at a settable distance, and defining a pressure zone therebetween, holder means for maintaining the setting of said distance, first and second die means clamping said work therebetween, a work loading and heating station upstream of said pressure zone for receiving and heating the work up to a predetermined temperature, said work loading station being arranged to receive said die means, a die release station downstream of said pressure zone, and including die separating means for separating one of said die means from the other of said die means following shaping of said work into a part, a pair of rails located above a plane operatively defining an upper surface of said other die means a pair of longitudinal wedges secured to said rails, the thin end of each wedge facing said work loading station, first roller means in operative contact with one of said members for transporting at least one of said die means along a transport direction, and along a direction opposite thereto, said first roller means including a plurality of rollers, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure transferring element being formed with lateral projections on opposite minor sides thereof, respectively, at a level so that upper longitudinal surfaces of said wedges lift said pressure-transferring elements away from said other die means upon making contact with said lateral projections, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passes through said converging pressure zone, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges.

33. The apparatus as claimed in claim 32, further comprising a sleeve surrounding each lateral projection, and being freely rotatable therearound.

* * * * *